United States Patent [19]

Wilkinson

[11] Patent Number: 5,020,334

[45] Date of Patent: Jun. 4, 1991

[54] LOCALIZED AIR DEHUMIDIFICATION SYSTEM

[75] Inventor: William H. Wilkinson, Columbus, Ohio

[73] Assignee: Gas Research Institute, Chicago, Ill.

[21] Appl. No.: 483,675

[22] Filed: Feb. 23, 1990

[51] Int. Cl.[5] ..... F25D 23/00

[52] U.S. Cl. ..... 62/271; 62/94

[58] Field of Search ..... 62/92, 93, 271, 94; 165/103, 909

[56] References Cited

U.S. PATENT DOCUMENTS

| | | | |
|---|---|---|---|
| 3,818,718 | 6/1974 | Freese | 62/93 |
| 3,910,062 | 10/1975 | Rojas | 62/93 |
| 3,995,689 | 12/1976 | Cates | 62/304 |
| 4,474,021 | 10/1984 | Harband | 62/271 X |
| 4,646,819 | 3/1987 | Pridham | 62/93 |
| 4,723,417 | 2/1988 | Meckler | 62/271 |
| 4,905,479 | 3/1990 | Wilkinson | 62/271 |
| 4,939,906 | 7/1990 | Spatz et al. | 62/271 |

*Primary Examiner*—Lloyd L. King

*Attorney, Agent, or Firm*—Watkins, Dunbar & Pollick

[57] ABSTRACT

A building hybrid air conditioning system having a conventional refrigeration subsystem in combination with a liquid desiccant dehumidification subsystem that dehumidifies make-up ventilation air is provided with an additional and localized dehumidifier assembly that cooperates with the dehumidification subsystem liquid desiccant central supply to remove excess moisture from its localized zone in by-pass relation to system dehumidification of the make-up ventilation air.

10 Claims, 3 Drawing Sheets

LOCALIZED AIR DEHUMIDIFICATION SYSTEM

FIELD OF THE INVENTION

The present invention relates generally to air conditioning accomplished with a hybrid air conditioning system wherein sensible heat removal loads are handled with a conventional refrigeration subsystem and wherein latent heat removal loads are handled with a liquid desiccant dehumidification subsystem, and particularly concerns an air dehumidification unit which may advantageously incorporated into the hybrid system to accomplish air dehumidification in a localized zone.

BACKGROUND OF THE INVENTION

Numerous applications of desiccant dehumidification to the conditioning of air are known in the prior art. U.S. Pat. Nos. 3,401,530 and 3,488,971 TO Meckler, and 4,164,125 to Griffiths, for instance, utilize a solid desiccant for the application. Similarly, U.S. Pat. Nos. 4,011,731 to Meckler, and 4,171,620 to Turner teach the use of a desiccant in the conditioning of air but emphasize the use of liquid desiccant and materials. Also, Meckler's U.S. Pat. No. 3,102,399 suggests a building air conditioning system wherein make-up ventilation air is subjected to liquid desiccant dehumidification in a two-stage dehumidification process to improve total system performance efficiency but he is forced to use a two-stage dehumidification process.

U.S. Pat. No. 4,171,624 to Meckler et al. teaches the use of thermal compressor means to regenerate or concentrate a dilute disiccant solution. Meckler also, in U.S. Pat. No. 4,222,244 for example, teaches the use of solar energy in desiccant regeneration for an air conditioning system. See also U.S. Pat. No. 4,577,471 to Meckler in the regard.

U.S. Pat. No. 4,259,849 to Griffiths also teaches the use of heat obtained from the condenser of a conventional vapor compression refrigeration system for effecting liquid desiccant regeneration.

U.S. Pat. No. 3,247,679 issued to Meckler discloses an engine-driven vapor compression refrigeration subsystem in a comfort conditioning system that also utilizes a liquid desiccant dehumidification subsystem. Meckler's U.S. Pat. No. 3,153,914 teaches air conditioning with a liquid desiccant dehumidification dehumidifier but without supplemental refrigeration.

U.S. Pat. No. 2,981,078 discloses air cooling and dehumidification and dehumidification using a hygroscopic agent and a rotating foraminous disk partially immersed in the agent. Supplemental absorption or mechanical refrigeration is not suggested.

U.S. Pat. No. 2,355,828 to Taylor discloses an earlier combined refrigeration and dehumidification air conditioning system.

U.S. Pat. No. 2,262,954 to Mattern, et al., discloses an air dehumidification system with controls to prevent desiccant crystallization during liquid desiccant regeneration. U.S. Pat. No. 2,557,204 to Richardson also teaches liquid desiccant regeneration in a manner that improves the reclamation of waste heat.

For other variations of air conditioning systems employing liquid desiccant solutions for dehumidification of air see U.S. Pat. Nos. 4,635,446, 4,691,530, and 4,723,417, all issued in the name of Meckler.

U.S. Pat. No. 3,818,718 issued to Freese discloses in-line apparatus for removing entrained water or moisture from a compressed air supply.

U.S. Pat. No. 3,910,062 to Rojas teaches moisture removal and air cooling apparatus but does not disclose or suggest the use of liquid desiccant solutions.

U.S. Pat. No. 4,646,819 to Pridham also discloses in-line apparatus for removing moisture from compressed air by heat exchange processes.

SUMMARY OF INVENTION

A building air conditioning system configured in accordance with the present invention is comprised of a refrigeration subsystem and a cooperating liquid desiccant dehumidification subsystem. Broadly, the air conditioning system is of the type disclosed and claimed in co-pending U.S. Pat. application Ser. No. 302,428, filed Jan. 27, 1989, now U.S. Pat. No. 4,905,479. The refrigeration subsystem in one embodiment is an absorption chiller fueled by a natural gas energy source and modified to make reject heat for desiccant regeneration. In another embodiment the refrigeration subsystem is an engine-driven refrigerant vapor compressor fueled by a natural gas energy source. Either refrigeration subsystem provides available heat to the liquid desiccant dehumidification subsystem for effecting or assisting in effecting liquid desiccant regeneration (dilute desiccant solution concentration) in the latter subsystem without penalizing the efficiency of the refrigeration subsystem.

The refrigeration subsystem is provided in the invention for the purpose of effecting air temperature variation and control by handling the system sensible heat load associated with conditioned air recirculated within a building enclosed space. The liquid desiccant dehumidification subsystem is provided in the invention for the purpose of effecting relative humidity variation and control by handling the total system latent heat load associated with the building enclosed space.

In the preferred embodiment of the present invention, a building enclosed space is continuously or very nearly continuously provided with fractional ventilation air, usually ambient atmospheric air, from outside the enclosed space, and relative humidity control is primarily effected by processing that ventilation air fraction through the dehumidifier unit of the liquid desiccant dehumidification subsystem to accomplish moisture removal from the ventilation air. The processed fractional ventilation air is then combined (mixed) with air recirculated from the enclosed space and the resulting mixed air is lowered in temperature by the air conditioning system refrigeration subsystem.

The present invention further comprises a novel apparatus arrangement for specifically reducing the relative humidity load experienced in a localized air-conditioned building interior zone (e.g., a bathroom in a residential system application) without otherwise requiring the introduction of ambient or atmospheric air into the total system for dehumidification. Such apparatus arrangement comprises an additional dehumidifier assembly installed in the localized air-conditioned building interior zone usually creating a relatively large system latent heat removal load, and desiccant circulation means separately flowing liquid desiccant solutions, both relatively dilute and relatively concentrated, to and from the additional dehumidifier assembly. In one system embodiment the circulation means cooperatively connects the remote dehumidifier assembly to the total system centralized supply of concentrated desiccant solution and to the total system desiccant solution regenerator means. In another system embodiment, the desiccant circulation means is not connected to the overall system centralized desiccant supply and regenerator, but instead recirculates desiccant solution independently within the additional localized dehumidifier assembly and through an included, additional and independent desiccant regenerator element with an appropriate time delay to smooth out otherwise short-term peak or surging latent heat removal loads. In one of the specific embodiments of the invention a spirally fluted tube is utilized in effecting mass transfer from the high humidity air to the concentrated desiccant solution; such is accomplished further using forced air circulation or convection. In an alternate specific embodiment of the invention an integrally spined tube is utilized in effecting the mass transfer and such is accomplished utilizing natural air circulation or convection in the localized zone.

The foregoing and other advantages of the invention will become apparent from the following disclosure in which a preferred embodiment of the invention is described in detail and illustrated in the accompanying drawings. It is contemplated that variations in the structural features and arrangement of parts may appear to the person skilled in the art without departing from the scope or advantages of the invention defined by the included claims.

DETAILED DESCRIPTION OF THE INVENTION

Figure 3:
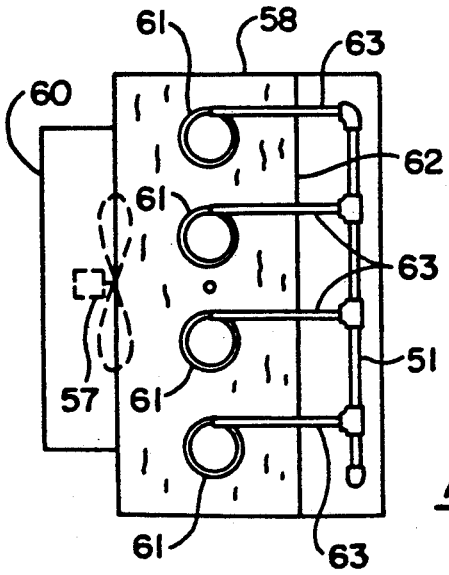
FIG. 3 is a plan view of the assembly illustrated in FIG. 2.

FIG. 3 schematically illustrates a hybrid air-conditioning system 10 to which the present invention pertains. Such system is of the type further discloses in the previously-mentioned co-pending U.S. Pat. application Ser. No. 302,428, filed Jan. 27, 1989. Such system includes, in part, conditioned air distribution subsystem 11 that recirculates air returned from within enclosed building space for reconditioning which typically involves cooing and a lowering of air moisture content on the average. Cooling is accomplished in system 10 by refrigeration subsystem 12 and dehumidification is accomplished by a liquid desiccant dehumidification subsystem essentially comprised of a dehumidifier unit 13 and a cooperating desiccant solution regenerator unit 14. Subsystem dehumidifier unit 13 normally processes factional ventilation air (15) received from the atmosphere exterior to the building conditioned by system 10. Such ventilation air, after processing in dehumidifier unit 13, is flowed to distribution subsystem 11 for mixing with recirculated building air and for cooling by a medium (e.g., chilled water) circulated from refrigeration subsystem 12 through lines 16 and 17. Distribution subsystem 11 conventionally includes a distribution duct 18 which flows conditioned air to representative enclosed localized zones (e.g., residential rooms) 19 through 21, a return duct means 22, a blower or fan (not shown), and various conventional accessories such as dampers, louvered outlets, controls, etc.

A conventional cooling tower subsystem 20 is situated in the exterior atmosphere and flows evaporatively cooled water to subsystems 12 and 13 through lines 23 and 24 to cool the refrigeration subsystem absorber in the case of an absorption refrigeration subsystem and to cool a heat transfer coil (not shown) in air dehumidifier unit 13, respectively. Cooling water heated in subsystem 12 and unit 13 is returned to subsystem 20 for cooling through lines 25 and 26, respectively.

A liquid desiccant such as a relatively concentrated lithium chloride solution is flowed from the collector of desiccant regenerator unit 14 by means of a circulating pump 27 through connected lines 28, 29, 30, 31, 32, and 33 to a spray head in dehumidifier unit 13. Such desiccant solution is typically cooled in heat exchanger 34 by the counter flow of relatively dilute spent desiccant solution flowed from the collector of dehumidifier unit 13 to regenerator unit 14 by means of circulation pump 35 and connected lines 36 through 43. Also, such desiccant solution may preferably be flowed from line segment 42 to line segment 43 in heat exchange relation to an absorption refrigeration absorber component (not shown) included in refrigeration subsystem 12. Similarly, such dilute desiccant solution may be further heated by a heat exchange relationship to auxiliary burner 44 prior to introduction into unit 14 for regeneration in a conventional manner. Valves 45 and 46 are provided in system 10 to control the concentration of the recirculated desiccant solution in response dehumidification "demand" sensed by a "humidistat" control located interiorly of the building zones serVed by system 10 and distribution ductwork 18. A by-pass line 47 connects lines 29, 30 to lines 41, 42 for use when valves 46 is in a closed condition.

In order to improve the performance efficiency of system 10, I further provide the schematically disclosed apparatus with an additional air dehumidification unit 50 which is situated in a building zone (such as 21) having a local high dehumidification load. In a typical residential application, for instance, zone 21 may be a bathroom having a conventional hot water shower spray, bath tub, "Jacuzzi" tub, or the like. Dehumidification unit 50 is connected to the system central concentrated desiccant solution supply through lines 51 and 52 connected to lines 31, 32 and 39, 40 and the flow of desiccant solution through such lines is controlled by valve 53 and circulation pump 54.

Figure 2:
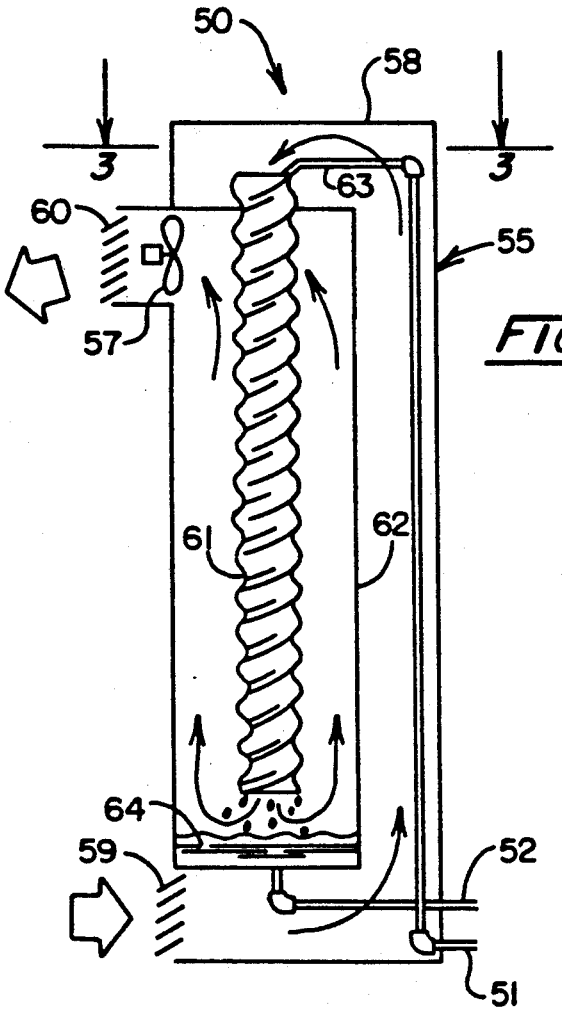
FIG. 2 is an elevational view of one embodiment of the remote dehumidifier assembly illustrated in FIG. 1, said assembly having a spirally fluted tube for effecting dehumidification mass transfer.
Figure 4:
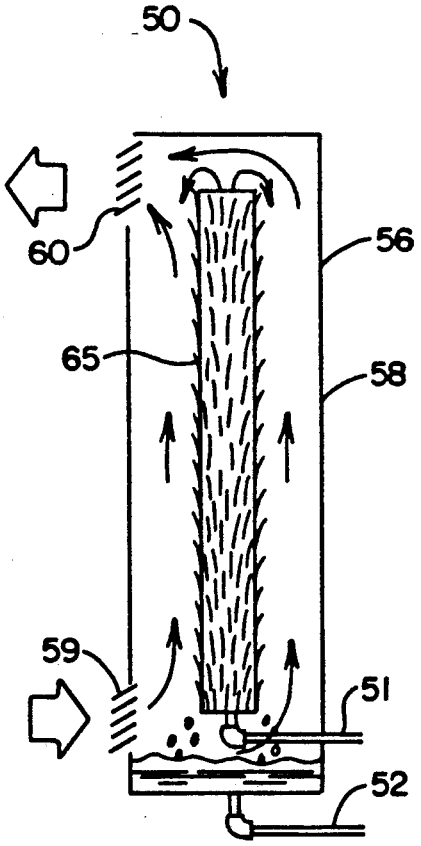
FIG. 4 is an elevational view of an alternate embodiment of the remote dehumidifier assembly illustrated in FIG. 1 but having a integrally spined tube which effects dehumidification mass transfer.

A preferred embodiment 55 of additional dehumidifier unit 50 is schematically illustrated in elevation in FIG. 2. An alternate embodiment 56 is illustrated in FIG. 4. Unit embodiment 55 relies on a fan or blower component 57 to develop a flow of the relatively humid air in zone 21 through the unit; unit embodiment 56, on the other hand, develops air circulation naturally through conventional air convection forces.

Unit embodiment 55 is basically comprised of an enclosure or housing 58 having louvered inlet and outlet openings 59, 60. Multiple conventional, spirally-fluted tube means 61 are positioned interiorly of enclosure 58 and are supported in place by cooperation with baffle 62. Relatively concentrated desiccant solution is flowed from the system central supply through line 51 and onto the upper interior surfaces of tubes 61 through tubular feed elements 63 connected to line 51. The liquid desiccant then flows by gravitational force downwardly over, and wets the interior surface of, each tube means 61.

The relatively humid air existing in zone 21 is inductively drawn through inlet opening 59 by operation of fan 57 and flows in the space between enclosure 58 and baffle 62 also to the upper extreme of spiral tube means 61 and then through the interior passageways of tube means 61 and on to outlet opening 60. Water is removed from such air in the interior of tube means 61 by mass transfer to the relatively concentrated desiccant solution flowed into the tube interior through feed elements 63. Relatively dilute desiccant solution 64 then drips from the lowermost extreme of tube means 61 and collects in the illustrated sump defined by portions of enclosure 58 and baffle 62 from where it is returned to the system desiccant solution regenerator unit 14 through line 52.

Unit embodiment 56 has a housing or enclosure 58 but not an interior baffle and inlet and outlet openings 59, 60. Multiple conventional integrally-spined tube means 65 are positioned vertically and interiorly of housing 58 by suitable support means (not shown) and each is provided with an enclosed lowermost extreme. Supply line 51 flows relatively concentrated desiccant solution from the system regenerator unit 14 to the interior of tube means 65 and such solution, after filling the interior of the tubes, cascades or flows over and wets the exterior surfaces of such tube means 65 including the integral spines. Satisfactory test results suggest the tube spines may be oriented in either an upward and outward direction relative to the tube surface or alternatively in a downward and outward direction.

Relatively humid air flowed through inlet opening 59 by natural convection forces passes around tube means 65 and its water content is reduced by mass transfer to the concentrated desiccant solution at the exterior of tube means 65. Dilute desiccant solution 64 drips from the lower extreme of tube means 65 and collects in the sump defined by the lower extreme of enclosure 58. Such relatively dilute desiccant solution is then flowed from the sump to desiccant regenerator unit 14 through line 52. Also, the air flowing over the surface of tube means 65 is heated in the mass transfer process thus supplementary the convective forces that otherwise occur in unit 50.

In both embodiments the dehumidified air flowed through the unit is heated to a degree in the mass-transfer process.

Figure 1:
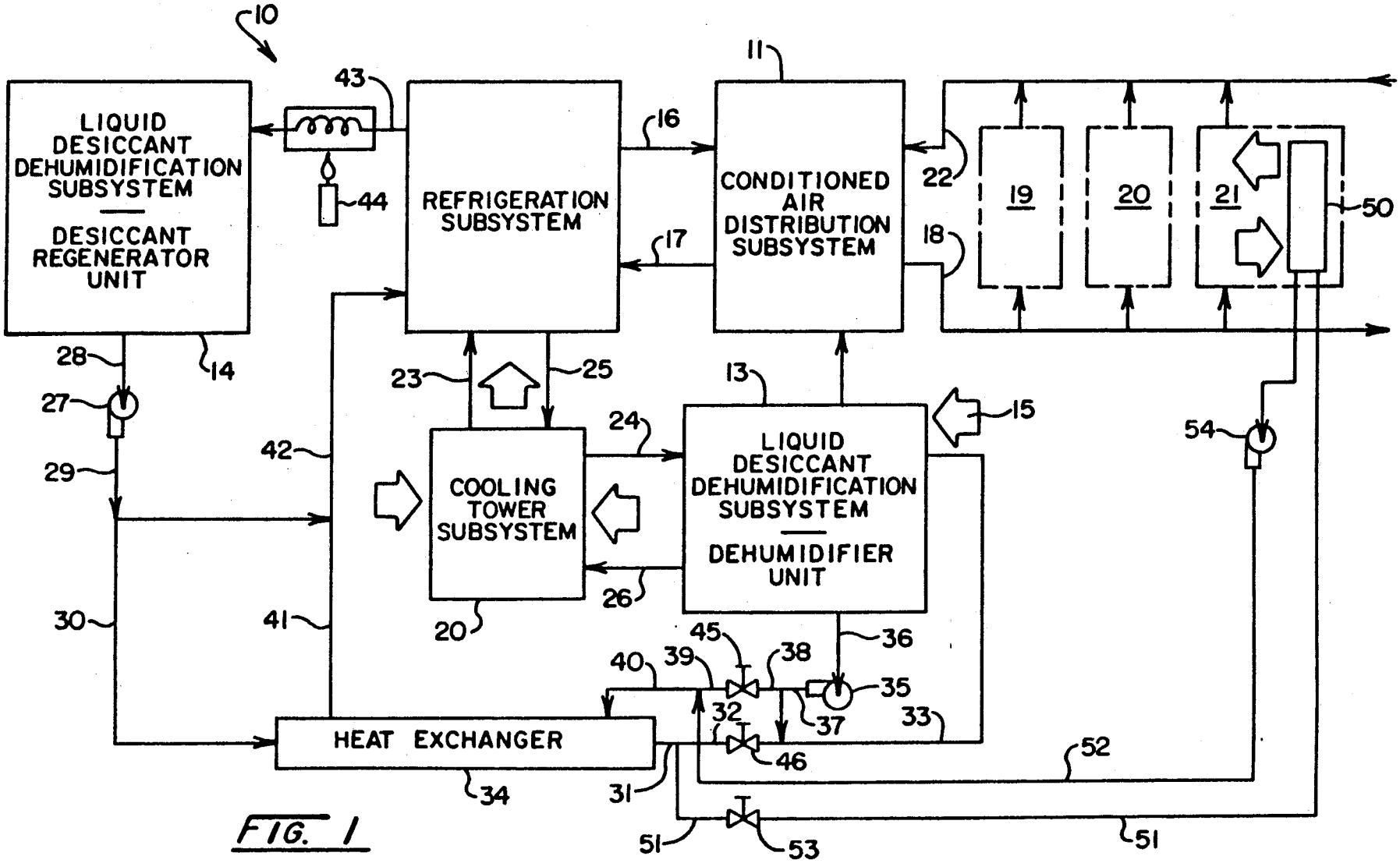
FIG. 1 is a schematic illustration of the type of hybrid air conditioning system to which the present invention pertains and further illustrates schematically the additional apparatus which is included to specifically accomplish latent heat load removal from a localized air-conditioned zone.
Figure 5:
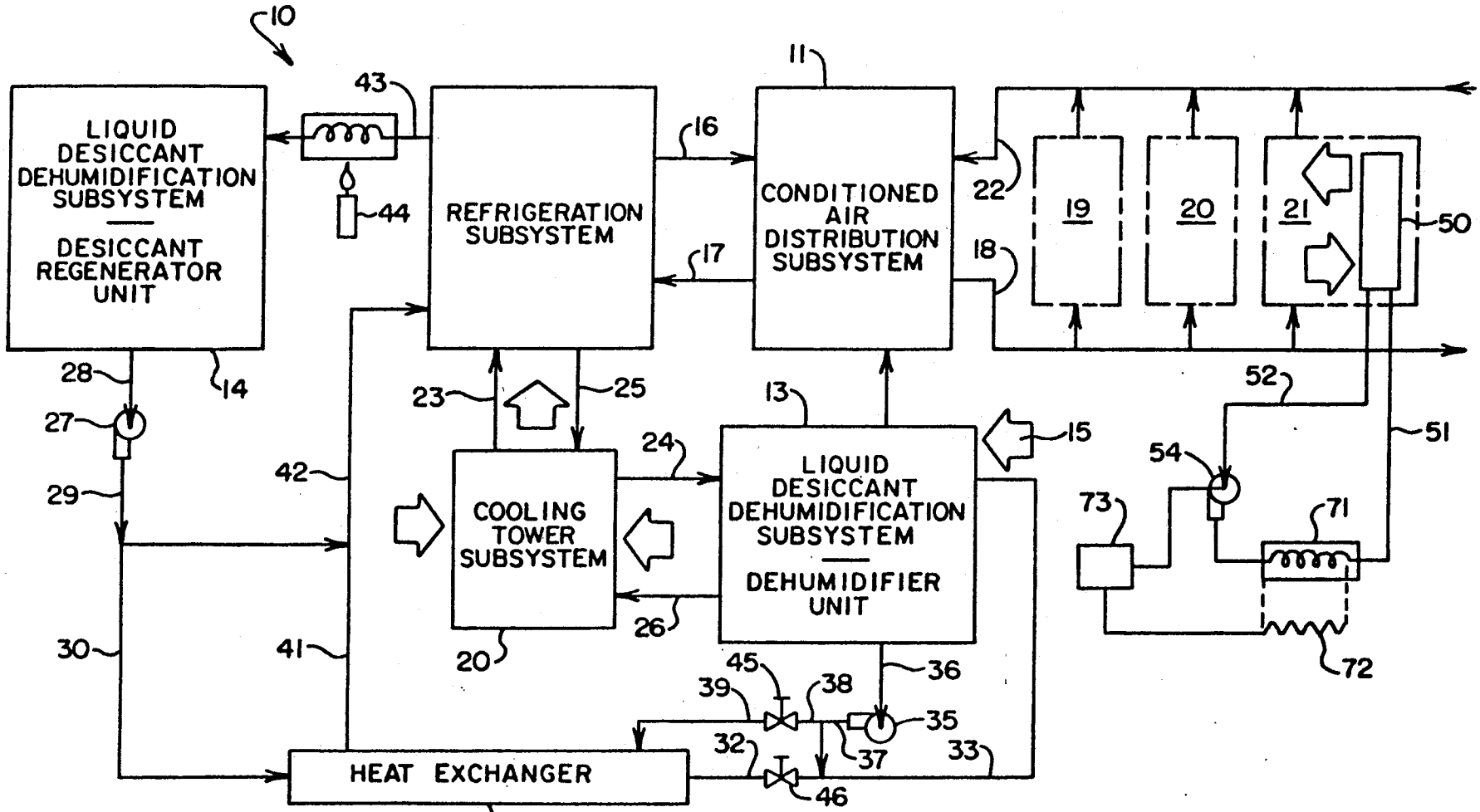
FIG. 5 is a schematic illustration generally similar to FIG. 1 but showing an alternate additional dehumidifier assembly arrangement.

An alternate embodiment of my "dehumidified zone within a dehumidified zone" air conditioning apparatus invention is illustrated schematically in FIG. 5. The FIG. 5 arrangement is generally similar to the FIG. 1 arrangement except that additional air dehumidifier unit 50 in localized zone 21 is not cooperatively connected to the system liquid desiccant lines 32 and 40. Instead, the alternate arrangement utilizes a supply of liquid desiccant solution which is independent of the liquid desiccant solution flowed between dehumidifier unit 13 and regenerator unit 14.

As illustrated in FIG. 5, relatively dilute desiccant solution collected in the sump of additional dehumidifier unit 50 is circulated through line 52 by pump means 54 to a heat exchanger 71 which is heated by electrical heating element 72. The heated dilute desiccant solution is then flowed through line 51 to the mass-transfer tube 61 (or 65) incorporated in additional dehumidifier unit 50 of the system. In this arrangement, pump means 54 and heater element 72 are separately and selectively operated by control 73. Control 73, for instance, may be a manually operable programmed off-on switch connected to an appropriate electrical energy supply. In such a configuration, energizing control 73 to the "on" condition actuates pump means 54 and flows relatively concentrated desiccant solution to additional dehumidifier 50 until control 73 is moved to an "off" condition thereby removing moisture from air recirculated in zone 21 over a relatively short-term period and providing some supplemental mass transfer heat to zone 21. Once being turned manually to the "off" condition, for instance, control 73 after a short delay is automatically reset and energizes both pump means 54 and heater element 72. Heater element 72 is intentionally selected to provide regeneration energy to the recirculated relatively dilute desiccant solution collected in the sump of unit 50 over a comparatively long period of time, e.g. 3–4 hours. As the heated solution is flowed to and through unit 50 the included excess moisture is evaporated to air circulated through zone 21 by air distribution subsystem 11 for eventual removal by the dehumidifier unit 13 of the system liquid desiccant dehumidification subsystem.

It is herein understood that although the present invention has been specifically disclosed with the preferred embodiments and examples, modifications and variations of the concepts herein disclosed may be resorted to by those skilled in the art. Such modifications and variations are considered to be within the scope of the invention and the appended claims.

I claim:

1. A building air-conditioning system for effecting air temperature and moisture content changes in air distributed to, flowed through, and recirculated from multiple separate building occupancy zones, comprising:

a.) a plurality of separate building occupancy zones which together source a system base sensible heat load and a system base latent heat load, and which has at least one building occupancy zone which sources a system intermittent local latent heat load which is in addition to said system base latent heat load;

b.) a refrigeration sub-system handling said system base sensible heat load and effecting temperature changes in recirculated air distributed to said separate building occupancy zones;

c.) a first dehumidification subsystem handling said system base and additional intermittent local latent heat loads, effecting moisture content changes in recirculated air distributed to said separate building occupancy zones, and comprising a first desiccant dehumidifier unit, a first concentrated desiccant solution supply cooperating with said first desiccant dehumidifier unit, and a first dilute desiccant solution regenerator cooperating with said first desiccant dehumidifier unit and with said first concentrated desiccant solution supply; and d.) a second desiccant dehumidification subsystem comprising a second desiccant dehumidifier unit located within said one building occupancy zone, a second concentrated desiccant solution supply cooperating with said second desiccant dehumidifier unit, and means recirculating air within said one building occupancy zone in mass-transfer relation to said second desiccant dehumidifier unit to effect moisture content changed in air recirculated within said one building occupancy zone by said air recirculating means, said second desiccant dehumidification subsystem transferring moisture from said second desiccant dehumidifier unit for subsequent removal from the building through said first desiccant dehumidification subsystem dehumidifier unit and connected dilute desiccant solution regenerator.

2. The system defined by claim 1 wherein said second dehumidifier unit comprises an array of vertically-oriented, mass-transfer tubes, distribution means flowing concentrated desiccant solution for gravity flow over at least one generally vertical surface of each of said mass-transfer tubes, and duct means recirculating air from said one building occupancy zone in contacting relation to said concentrated desiccant solution.

3. The system defined by claim 2 wherein said mass-transfer tubes are each spirally fluted.

4. The system defined by claim 2 wherein said mass-transfer tubes are each provided with multiple, closely-spaced and radially projected integral spines.

5. The system defined by claim 2 wherein, said air from said one building occupancy zone is recirculated through said additional dehumidifier unit for forced convection by a blower means.

6. The apparatus defined by claim 2 wherein said air from said one building occupancy zone is recirculated through said additional dehumidifier unit for natural convection by a developed temperature differential.

7. The system defined by claim 1 wherein said second dehumidifier unit is operably connected to said liquid desiccant dehumidification subsystem concentrated desiccant solution supply and to said liquid desiccant dehumidification subsystem dilute desiccant solution regenerator.

8. The system defined by claim 1 wherein said second dehumidifier unit has a liquid desiccant solution separate from said dehumidification subsystem liquid desiccant solution, a dilute desiccant solution heater means, and control means selectively energizing said desiccant solution heater means.

9. The system defined by claim 1 wherein said second concentrated desiccant solution supply is obtained from said first concentrated desiccant solution supply, and wherein dilute desiccant solution is flowed from said second desiccant dehumidifier unit to said first dilute desiccant solution regenerator to transfer moisture from said one building occupancy zone to outside said building.

10. The system defined by claim 1 wherein said second concentrated desiccant solution supply is separate from said first concentrated desiccant solution supply, said second desiccant dehumidifier unit transferring dilute desiccant solution to a second desiccant dehumidification subsystem regenerator for release into recirculated air flowed from said one building occupancy zone to said first desiccant dehumidifier unit.

* * * * *